US008870984B2

(12) United States Patent
Lamprecht et al.

(10) Patent No.: US 8,870,984 B2
(45) **Date of Patent: *Oct. 28, 2014**

(54) COLD FLOW RESPONSE OF DIESEL FUELS

(71) Applicant: Sasol Technology (Pty) Ltd, Johannesburg (ZA)

(72) Inventors: Delanie Lamprecht, Vanderbijilpark (ZA); Vivien Louise Van Zyl, Vanderbijilpark (ZA); Stefan De Goede, Vanderbijilpark (ZA)

(73) Assignee: Sasol Technology (Pty) Ltd, Johannesburg (ZA)

( * ) Notice: Subject to any disclaimer, the term of this patent is extended or adjusted under 35 U.S.C. 154(b) by 0 days.

This patent is subject to a terminal disclaimer.

(21) Appl. No.: 14/010,464

(22) Filed: Aug. 26, 2013

(65) Prior Publication Data

US 2014/0053459 A1 Feb. 27, 2014

Related U.S. Application Data

(63) Continuation of application No. 12/601,771, filed as application No. PCT/ZA2008/000042 on May 30, 2008, now abandoned.

(30) Foreign Application Priority Data

May 31, 2007 (ZA) ..... 07/4509

(51) Int. Cl.

| | |
|---|---|
| ***C10L 10/14*** | (2006.01) |
| ***C10L 1/08*** | (2006.01) |
| ***C10L 1/197*** | (2006.01) |
| ***C10L 1/14*** | (2006.01) |
| ***C10G 2/00*** | (2006.01) |
| *C10L 1/16* | (2006.01) |

(52) U.S. Cl.

CPC . *C10L 10/14* (2013.01); *C10L 1/08* (2013.01); *C10L 1/1973* (2013.01); *C10L 1/143* (2013.01); *C10G 2/30* (2013.01); *C10G 2300/1022* (2013.01); *C10G 2300/301* (2013.01); *C10G 2300/1033* (2013.01); *C10G 2300/80* (2013.01); *C10L 1/1616* (2013.01); *C10G 2400/04* (2013.01); *C10G 2300/30* (2013.01)

USPC ..... 44/601

(58) Field of Classification Search

CPC ..... C10L 10/14

USPC ..... 208/15; 424/59, 63, 64, 65, 70.7, 70.9; 585/14; 44/436, 601; 510/130, 267, 510/445; 514/4, 772.3

See application file for complete search history.

(56) References Cited

U.S. PATENT DOCUMENTS

| | | | | |
|---|---|---|---|---|
| 2005/0279669 | A1* | 12/2005 | Schaberg | 208/15 |
| 2006/0137242 | A1 | 6/2006 | Siggelkow et al. | |
| 2006/0229222 | A1* | 10/2006 | Muller et al. | 510/267 |
| 2008/0155889 | A1* | 7/2008 | O'Rear | 44/436 |

FOREIGN PATENT DOCUMENTS

| | | | |
|---|---|---|---|
| EP | 0153176 | B1 | 8/1885 |
| EP | 1 690 919 | A | 8/2006 |
| JP | 2005 002229 | A | 1/2006 |
| JP | 2006 016541 | A | 1/2006 |

* cited by examiner

*Primary Examiner* — Prem Singh
*Assistant Examiner* — Chantel Graham
(74) *Attorney, Agent, or Firm* — Knobbe, Martens, Olson & Bear, LLP.

(57) ABSTRACT

The invention provides a blend of FT derived diesel, crude derived diesel, and CFPP improving additive, wherein the FT diesel is from 1 vol % to 50 vol % of the blend, said blend having a CFPP of below −18° C. The invention extends to use of FT diesel as a blend component for a compression ignition fuel blend, said blend including the FT diesel, a crude derived diesel fuel and a CFPP improver additive, wherein the FT diesel is from 1 vol % to 50 vol % of the blend, which blend has a CFPP of below −20° C.

20 Claims, No Drawings

COLD FLOW RESPONSE OF DIESEL FUELS

INCORPORATION BY REFERENCE TO RELATED APPLICATIONS

Any and all priority claims identified in the Application Data Sheet, or any correction thereto, are hereby incorporated by reference under 37 CFR 1.57. This application is a continuation of U.S. application Ser. No. 12/601,771 filed Feb. 1, 2010, which is the national phase under 35 U.S.C. §371 of prior PCT International Application No. PCT/ZA2008/000042 which has an International filing date of May 30, 2008, which designates the United States of America, and which claims the benefit of South African Application No. 2007/4509 filed May 31, 2007, the disclosures of which are hereby expressly incorporated by reference in their entirety and are hereby expressly made a portion of this application.

FIELD OF THE INVENTION

The invention relates to maintaining and/or improving cold flow properties of diesel fuels which include Fischer Tropsch (FT) derived fuel and a CFPP additive.

BACKGROUND TO THE INVENTION

In cold climates the Cold Filter Plugging Point (CFPP) (EN116) of diesel fuels is very important and is specified in various standards such as the European diesel specification, EN590, where the climate related requirements vary from −20° C. CFPP for countries such as Germany to −10° C. and −5° C. respectively for countries such as Portugal and Greece. Countries such as Switzerland, Finland, Sweden, Norway and Denmark have adopted EN590 artic grade cold flow requirements with winter CFPP ranges being from −20° C. (Artic grade 0) to −32° C. (Arctic grade 2).

The cold flow behaviour of diesel fuels generally depends on their molecular structure. Fuels usually contain a mixture of hydrocarbons including n-paraffins, branched linear paraffins, olefins, aromatics and other non-polar and polar compounds. The straight chain hydrocarbons which have the lowest solubility in the fuel tend to separate as waxes at low temperatures below the cloud point of the fuel. The n-paraffins distribution of diesels is typically in the range of C9-C28 although the carbon chain length sometimes extends to the mid to upper thirties. As the chain length of the n-alkane molecule increases, its solubility in the fuel at low temperatures decreases and the rate of separation increases. Upon continuous lowering of temperature below the fuel cloud point, these waxes start to adhere together to form a network which eventually prevents the flow of the fuel as measured by the pour point test. Also the large wax platelets formed tend to block the diesel fuel filter and prevent the engine operation at temperatures below the fuel cloud point. This behaviour can be simulated using lab tests such as the cold filter plugging point (CFPP) test.

The addition of cold flow additives such as ethylene vinyl acetate (EVA) based co-polymers, tend to enhance the cold flow characteristics of these fuels. These additives function by reducing the size and changing the shape of the wax crystals. They also reduce the tendency of the crystals to adhere together and form a gel. Flow improvers are most effective in fuels with a low concentration of widely distributed waxy n-paraffins, since crystal growth is slow in such fuels and flow improver molecules can effectively co-crystallize on slowly growing wax crystals.

As a fuel is cooled to its cloud point, the normal paraffins begin to separate from the fuel wax. Upon further cooling, more wax appears and adds to these initial crystals. These crystals rapidly grow to a size which prevents fuel flow. Flow improvers act to modify the wax as it forms in the following ways:

Nucleation: Additive composition is adjusted such that at the fuel cloud point many artificial nuclei become available on which wax crystals grow.

Growth arresting: During crystal growth around the nuclei, additive molecules also act to prevent further growth.

Both of these effects combine and result in the formation of many very small crystals rather than fewer larger crystals. These small crystals pass through the filters and/or form permeable cakes on the filter medium to allow continued operability until the fuel has warmed and the wax redissolves.

It is believed that, amongst other factors, the following factors affect a fuel's response to flow improver additive:

Size of the crystal formed
The rate of wax precipitation
Wax carbon number range
Fractionation sharpness
Wax content and type.

Narrow cut fuels, which are fractionated sharply, tend to be less responsive to flow improvers because they have a higher wax precipitation rate. It is generally agreed that flow improvers reduce filter plugging temperatures by co-crystallizing with n-paraffin molecules to inhibit wax crystal growth. This implies there is a balance between the rate of crystal growth and the rate of co-crystallization. If the rate of crystal growth is slow, the flow improver has a better chance of co-crystallization with the growing wax crystal and inhibits its growth. If the rate of crystal growth is rapid, large crystals form before the flow improvers can co-crystallize with them to hinder their growth. Fuels with a wide carbon distribution contain many different n-paraffinic molecules and it is believed that crystals from a mixture of n-paraffins grow at a slower rate than crystals formed from a single n-paraffin, because n-paraffins in mixtures do not line up side by side to form a new layer on the crystal. Since mixed n-paraffin crystals grow slowly, flow improvers have more time to interact with the growing crystals and inhibit their growth.

FT derived diesel consists of approximately 50% n-paraffins compared to an EN590 conventional diesel that contains less than 20% n-paraffins. Although FT derived diesel has a normal boiling range, comparable to that of EN590 diesels, the large total volume of n-paraffins may enhance crystal growth rate to the extent that it decrease the effectiveness of flow improvers compared to conventional diesels It was thus expected that if FT derived diesel were blended with a crude oil derived diesel this would reduce the effectiveness of the CFPP additives on the blend.

Moreover, it was expected that a narrow cut FT derived diesel would reduce the effectiveness of the CFPP additives on the blend.

Surprisingly the inventors have solved the problem of the CFPP of FT derived diesel and crude oil derived diesel blends in the presence of CFPP additives.

SUMMARY OF THE INVENTION

According to a first aspect of the invention there is provided a FT derived diesel, crude derived diesel, and CFPP improving additive blend, wherein the FT diesel is from 1 vol % to 50 vol % of the blend, said blend having a CFPP of below −18° C.

Typically, the FT diesel is from 5 vol % to 40 vol % of the blend and the CFPP of the blend is below −20° C.

Typically, the FT diesel is from 5 vol % to 20 vol % of the blend and the CFPP of the blend is below −20° C.

The CFPP improving additive is usually from 50 ppm to 1000 ppm of the blend, typically 100 ppm to 1000 ppm, more typically from 250 ppm to 1000 ppm.

The FT diesel may have a >C19 wax content of less than 3.2 mass %, in some embodiments less than 2.4 mass %, even less than 1.8 mass %, typically 1.6 mass %.

The FT diesel may have a CFPP of −5° C. to −18° C., typically −10° C. to −18° C.

The FT diesel may have a CFPP of −18° C. with the following characteristics:

| | −18° C. CFPP FT diesel |
|---|---|
| CFPP (° C.) | −18 |
| Cloud Point (° C.) | −17.4 |
| Pour Point (° C.) | −21 |
| Density @15° C. (kg/m$^3$) | 767.8 |
| Distillation (D86) | |
| IBP (° C.) | 166 |
| 5% (° C.) | 189 |
| 10% (° C.) | 196 |
| 20% (° C.) | 206 |
| 30% (° C.) | 218 |
| 40% (° C.) | 233 |
| 50% (° C.) | 247 |
| 60% (° C.) | 262 |
| 70% (° C.) | 277 |
| 80% (° C.) | 293 |
| 90% (° C.) | 312 |
| 95% (° C.) | 326 |
| FBP (° C.) | 334 |
| FBP-90% | 22 |
| 90%-20% | 106 |

The FT diesel may have a T90-T20 of 120° C. to 105° C.

The FT diesel may be defined as a winter diesel conforming to a CFPP of less than −10° C.

The crude derived diesel may have a CFPP of −5° C. to −15°, typically −10° C. to −15° C.

The crude derived diesel may have a T90-T20 of 60° C. to 130° C.

The crude derived diesel may have FBP-T90 of 23° C. to 35° C.

The crude-oil derived diesel can either be a narrow cut or a wide cut diesel

The invention extends to the use of FT diesel as a blend component for a compression ignition fuel blend, said blend including the FT diesel, a crude derived diesel fuel and a CFPP improver additive, wherein the FT diesel is from 1 vol % to 50 vol % of the blend, which blend has a CFPP of below −20° C.

Typically, the FT diesel is from 5 vol % to 40 vol % of the blend and the CFPP of the blend is below −20° C.

The CFPP of a blend including around 20 vol % FT diesel is typically less than −20° C. at CFPP improver dosage rates less than 500 ppm for narrow cut crude-oil derived diesel and less than −30° C. for wide cut crude-oil derived diesels at similar dosage rates.

The CFPP improving additive is usually from 50 ppm to 1000 ppm of the blend.

SPECIFIC EXAMPLE OF THE INVENTION

The invention will now be described, by way of non-limiting examples only.

The results showed that the diesel fuel composition resulted in a better than expected cold flow property response of the additive on the composition and thus of the composition.

In the experiment, FT diesel samples were evaluated to investigate the effect on cold flow improver performance when adding a winter grade FT diesel to wide and narrow EN590 diesels. Selected fuel properties of the base fuels are shown in Table 1 and Table 2. A FT diesel sample with a Cold Filter Plugging Point (CFPP) of −18° C. and another with a CFPP of −7° C. were tested with various CFPP improvers (additives). These results are shown in Table 3 to Table 6.

For this type of FT diesel, with a CFPP of −18° C. it has a paraffin content of 39.6 mass % and >C19 of 1.6 mass %, whereas one with a CFPP of −9° C. has a paraffin content of 41.4 mass % and >C19 of 3.4 mass %.

TABLE 1

| FT diesel Characteristics | | |
|---|---|---|
| | −18° C. CFPP FT diesel | −7° C. CFPP FT diesel |
| CFPP (° C.) | −18 | −7 |
| Cloud Point (° C.) | −17.4 | −3.1 |
| Pour Point (° C.) | −21 | −9 |
| Density @15° C. (kg/m$^3$) | 767.8 | 774.5 |
| Distillation (D86) | | |
| IBP (° C.) | 166 | 184 |
| 5% (° C.) | 189 | 205 |
| 10% (° C.) | 196 | 212 |
| 20% (° C.) | 206 | 224 |
| 30% (° C.) | 218 | 237 |
| 40% (° C.) | 233 | 252 |
| 50% (° C.) | 247 | 267 |
| 60% (° C.) | 262 | 284 |
| 70% (° C.) | 277 | 301 |
| 80% (° C.) | 293 | 319 |
| 90% (° C.) | 312 | 341 |
| 95% (° C.) | 326 | 356 |
| FBP (° C.) | 334 | 364 |
| FBP-90% | 22 | 23 |
| 90%-20% | 106 | 117 |

TABLE 2

Selected fuel properties of the crude-oil derived samples used in example 1

| | Fuel 1 German | Fuel 2 Dutch | Fuel 3 UK | Fuel 4 French | Fuel 5 Spanish |
|---|---|---|---|---|---|
| Cloud Point (° C.) | −7.6 | −7.1 | −7.2 | −9 | −5.3 |
| Density @15° C. (kg/m$^3$) | 829.3 | 830.9 | 839.7 | 832 | 839.9 |
| D86 (° C.) | | | | | |
| IBP | 213.4 | 180.8 | 183.7 | 162.5 | 168.5 |
| 5% | 209.6 | 197.9 | 205.2 | 186.8 | 192.8 |
| 10% | 221.5 | 210.7 | 219.5 | 199.2 | 196.7 |
| 20% | 231.7 | 224.7 | 238.3 | 215.8 | 210 |
| 30% | 241.8 | 237.5 | 253.1 | 232.9 | 223.2 |
| 40% | 252.9 | 250.5 | 265.4 | 248.2 | 239.1 |
| 50% | 264.4 | 263.4 | 277.3 | 261.7 | 255.8 |
| 60% | 275.3 | 276.2 | 287.5 | 274.2 | 272.7 |
| 70% | 286.7 | 291.3 | 300.1 | 287.8 | 291.1 |
| 80% | 299.5 | 307.9 | 312.6 | 303.9 | 312.1 |
| 90% | 317.9 | 331.6 | 329.4 | 324.5 | 337.4 |
| 95% | 335.9 | 349.0 | 342.7 | 344 | 356.5 |
| FBP | 352.6 | 362.5 | 351.7 | 354.9 | 367.1 |
| 90%-20% | 86.2 | 106.9 | 91.1 | 108.7 | 127.4 |
| FBP-90% | 34.7 | 30.9 | 22.3 | 30.4 | 29.7 |

Even though the effect of the winter FT diesel in a blend on the cold flow improver response is dependent on whether the base fuel is a narrow or wide cut crude derived diesel, several cold flow improvers, if not all of them, worked effectively in blends containing winter FT diesel with no significant deteriorating changes relative to the EN590 fuel containing no FT diesel.

At low concentrations of FT diesel, about less than 20 vol % FT, no negative effects on the cold flow improver additive response were observed.

Example 1

TABLE 3

Winter (−18° C. CFPP) FT diesel blends with a EN590 DIESEL at various dosage rates of additive A, B and C

| | FT-vol % | | | | | |
|---|---|---|---|---|---|---|
| | 0 | 5 | 10 | 15 | 20 | 40 |
| ppm | CFPP (° C.) | | | | | |
| GERMAN A | | | | | | |
| 0 | −12 | −13 | −13 | −13 | −14 | −16 |
| 200 | −18 | −18 | −19 | −19 | −18 | −20 |
| 300 | −20 | −20 | −21 | −22 | −21 | −22 |
| 400 | −22 | −23 | −22 | −22 | −21 | −22 |
| 500 | −24 | −25 | −26 | −24 | −23 | −27 |
| DUTCH A | | | | | | |
| 0 | −10 | −10 | −9 | −11 | −12 | −14 |
| 200 | −24 | −22 | −21 | −20 | −22 | −25 |
| 300 | −22 | −24 | −23 | −27 | −30 | −30 |
| 500 | −24 | −27 | −26 | −29 | −27 | −29 |
| UK B | | | | | | |
| 0 | −8 | −8 | −9.5 | −9.5 | −10 | −12 |
| 200 | −19 | −18 | −20 | −22 | −20 | −19 |
| 300 | −20 | −21 | −23 | −24 | −26 | −26 |
| 400 | −23 | −25 | −23 | −25 | −23 | −25 |
| 500 | −26 | −275 | −25 | −26 | −27 | −24 |
| French B | | | | | | |
| 0 | −11 | −11 | −12 | −12 | −14 | −16 |
| 100 | −23 | −22 | −25 | −27 | −25 | −21 |
| 200 | −25 | −28 | −26 | −26 | −25 | −25 |
| 300 | −27 | −25 | −28 | −29 | −26 | −26 |
| 400 | −30 | −27 | −32 | −27 | −25 | −28 |
| 500 | −27 | −31 | −27 | −30 | −28 | −26 |
| Spanish C | | | | | | |
| 0 | −8 | −7 | −8 | −9 | −9 | −12 |
| 100 | −20 | −21 | −22 | −22 | −22 | −25 |
| 200 | −23 | −27 | −26 | −27 | −23 | −27 |
| 300 | −22 | −29 | −29 | −29 | −31 | −28 |
| 400 | −27 | −31 | −30 | −30 | −30 | −29 |
| 500 | −25 | −31 | −31 | −32 | −31 | −32 |

Example 2

TABLE 4

Winter FT diesel blends with a narrow cut Scandinavian diesel at various dosage rates of CFPP improving additive

| | −18° C. CFPP FT | | | | −7° CFPP FT | | |
|---|---|---|---|---|---|---|---|
| | FT-vol % | | | | | | |
| CFPP additive | 0 | 3 | 5 | CFPP additive | 0 | 3 | 5 |
| | CFPP (° C.) | | | | CFPP (° C.) | | |
| 0 ppm | −11 | −11 | −11 | 0 ppm | −11 | −11 | −9 |
| 200 ppm | −18 | −19 | −25 | 200 ppm | −18 | −19 | −21 |
| 300 ppm | −19 | −24 | −21 | 300 ppm | −19 | −19 | −23 |
| 400 ppm | −19 | −23 | −25 | 400 ppm | −19 | −25 | −25 |

FT diesel blends with Scandinavian diesel improved the CFPP response when compared to the base fuel at similar CFPP improver dosage rates.

Example 3

TABLE 5

Winter FT diesel blends with a wide cut German diesel including Fatty Acid Methyl ester, at various dosage rates of CFPP additive

| | −18° C. CFPP FT | | | | −7° CFPP FT | | |
|---|---|---|---|---|---|---|---|
| | FT-vol % | | | | | | |
| CFPP additive | 0 | 5 | 10 | CFPP additive | 0 | 5 | 10 |
| | CFPP (° C.) | | | | CFPP (° C.) | | |
| 0 ppm | −8 | −8 | −8 | 0 ppm | −8 | −7 | −6 |
| 150 ppm | −27 | −27 | −28 | 150 ppm | −27 | −26 | −26 |

Example 4

A similar exercise was carried out with US 2-D diesel. It can be seen that although the −7° C. FT diesel resulted in a decrease in the CFPP of the US 2-D/FT blend, the US 2-D/FT blends remain highly treatable at 20 vol % FT content.

TABLE 6

HCP FT diesel blends with US 2-D at a dosage rate of 500 ppm of additive A

| | US 2D | 10 vol % FT | 15 vol % FT | 20 vol % FT | 50 vol % FT | FT |
|---|---|---|---|---|---|---|
| Neat blends | | | | | | |
| CFPP (° C.) | −14 | −13 | −11 | −12 | −8 | −7 |
| Cloud point (° C.) | −12.3 | −11.1 | −11.5 | −11.5 | −8.3 | −5.1 |
| Blends Additised with 500 ppm CFPP improver additive | | | | | | |
| CFPP (° C.) | −22 | −21 | −23 | −22 | −19 | −17 |
| Cloud point (° C.) | −10.8 | −10.8 | −10.8 | −10.7 | −8.2 | — |

What is claimed is:

1. A blend comprising a Fischer-Tropsch derived diesel, a crude derived diesel, and a cold filter plugging point improving additive, wherein the Fischer-Tropsch derived diesel has a cold filter plugging point of from −5° C. to −18° C. and comprises from 1 vol. % to 50 vol. % of the blend, wherein the blend has a cold filter plugging point of below −18° C., and wherein the Fischer-Tropsch derived diesel has a >C19 wax content of less than 3.2 mass %.

2. The blend of claim 1, wherein the Fischer-Tropsch derived diesel has a >C19 wax content of less than 1.6 mass %.

3. The blend of claim 1, wherein the Fischer-Tropsch derived diesel comprises from 5 vol. % to 40 vol. % of the blend, and wherein the blend has a cold filter plugging point of below −20° C.

4. The blend of claim 3, wherein the Fischer-Tropsch derived diesel comprises from 5 vol. % to 20 vol. % of the blend.

5. The blend of claim 1, wherein the cold filter plugging point improving additive comprises from 50 ppm to 1000 ppm of the blend.

6. The blend of claim 1, wherein the Fischer-Tropsch derived diesel has a cold filter plugging point of −18° C., a cloud point of −17.4° C., a pour point of −21° C., a density at 15° C. of 767.8 kg/m$^3$, and boiling point characteristics comprising:

| | |
|---|---|
| Initial Boiling Point (° C.) | 166° C. |
| 5% (° C.) | 189° C. |
| 10% (° C.) | 196° C. |
| 20% (° C.) | 206° C. |
| 30% (° C.) | 218° C. |
| 40% (° C.) | 233° C. |
| 50% (° C.) | 247° C. |
| 60% (° C.) | 262° C. |
| 70% (° C.) | 277° C. |
| 80% (° C.) | 293° C. |
| 90% (° C.) | 312° C. |
| 95% (° C.) | 326° C. |
| Final Boiling Point (° C.) | 334° C. |
| Final Boiling Point -90% (° C.) | 22° C. |
| 90%-20% (° C.) | 106° C. |

7. The blend of claim 1, wherein the Fischer-Tropsch derived diesel has a T90-T20 of from 120° C. to 105° C.

8. The blend of claim 1, wherein the Fischer-Tropsch derived diesel is a winter diesel conforming to a cold filter plugging point of less than −10° C.

9. The blend of claim 1, wherein the crude derived diesel has a cold filter plugging point of from −5° C. to −15° C.

10. The blend of claim 1, wherein the crude derived diesel has a T90-T20 of from 60° C. to 130° C.

11. The blend of claim 1, wherein the crude derived diesel has an FBP-T90 of from 23° C. to 35° C.

12. The blend of claim 1, wherein the Fischer-Tropsch derived diesel comprises approximately 50% n-paraffins and wherein the crude derived diesel comprises less than 20% n-paraffins.

13. The blend of claim 1, wherein the Fischer-Tropsch derived diesel has a >C19 wax content of from 1.6 mass % to less than 3.2 mass %.

14. The blend of claim 1, wherein the Fischer-Tropsch derived diesel has a >C19 wax content of less than 2.4 mass %.

15. The blend of claim 1, wherein the Fischer-Tropsch derived diesel has a >C19 wax content of less than 1.8 mass %.

16. The blend of claim 1, wherein the Fischer-Tropsch derived diesel has a >C19 wax content of from 1.6 mass % to less than 1.8 mass %.

17. The blend of claim 1, wherein the Fischer-Tropsch derived diesel has a cloud point of from −17.4° C. to −3.1° C.

18. The blend of claim 1, wherein the Fischer-Tropsch derived diesel has a paraffin content of 39.6 mass % to 41.4 mass %.

19. The blend of claim 1, wherein the Fischer-Tropsch derived diesel is a narrow cut Fischer-Tropsch derived diesel.

20. The blend of claim 19, wherein the cold filter plugging point improving additive comprises from 50 ppm to 1000 ppm of the blend.

* * * * *